US011725545B2

(12) United States Patent
Mariotti

(10) Patent No.: US 11,725,545 B2
(45) Date of Patent: Aug. 15, 2023

(54) INTERNAL COMBUSTION ENGINE WITH CAMSHAFT VALVE PHASE VARIATION DEVICE

(71) Applicant: PIAGGIO & C. S.P.A., Pontedera (IT)

(72) Inventor: Walter Mariotti, Pontedara (IT)

(73) Assignee: PIAGGIO & C. S.P.A., Pontedera (IT)

( * ) Notice: Subject to any disclaimer, the term of this patent is extended or adjusted under 35 U.S.C. 154(b) by 0 days.

(21) Appl. No.: 17/641,763

(22) PCT Filed: Sep. 11, 2020

(86) PCT No.: PCT/IB2020/058455

§ 371 (c)(1),
(2) Date: Mar. 9, 2022

(87) PCT Pub. No.: WO2021/048804

PCT Pub. Date: Mar. 18, 2021

(65) Prior Publication Data

US 2022/0381161 A1 Dec. 1, 2022

(30) Foreign Application Priority Data

Sep. 13, 2019 (IT) ..... 102019000016283

(51) Int. Cl.
*F01L 1/053* (2006.01)
*F01L 1/02* (2006.01)
(Continued)

(52) U.S. Cl.
CPC ..... *F01L 1/053* (2013.01); *F01L 1/022* (2013.01); *F01L 1/26* (2013.01); *F01L 1/344* (2013.01); *F01L 2001/0537* (2013.01)

(58) Field of Classification Search
CPC ..... F01L 1/34; F01L 1/344; F01L 13/0063; F01L 2800/00
See application file for complete search history.

(56) References Cited

U.S. PATENT DOCUMENTS 4,177,773 A 12/1979 Cribbs
4,955,330 A 9/1990 Fabi et al.
(Continued)

FOREIGN PATENT DOCUMENTS

GB 2263152 A 7/1993
JP S60113006 A 6/1985
WO 2015187469 A1 12/2015

OTHER PUBLICATIONS

International Search Report and Written Opinion Received for the PCT Application No. PCT/IB2020/058455 dated Dec. 15, 2020, 13 pages.

*Primary Examiner* — John Kwon
(74) *Attorney, Agent, or Firm* — Amster Rothstein & Ebenstein LLP

(57) ABSTRACT

A combustion engine for a vehicle includes a device for changing the timing of suction/relief valves with respect to the drive shaft. The device includes a first disc idly mounted to the camshaft and has a first side defining first slot tracks. A second disc is integral with the camshaft and includes second slot tracks facing the first side of the first disc. Drive elements transmit motion between the first disc and the second disc and each is accommodated between corresponding two of the partially facing tracks. As centrifugal forces caused by the rotation speed of the camshaft changes, each drive elements moves between a first reference position and a second reference position which are close to and far from the rotation axis of the camshaft, respectively. A phase changer device exerts a force which tends to oppose movement of said drive elements towards the second reference position.

10 Claims, 12 Drawing Sheets

(51) Int. Cl.
*F01L 1/26* (2006.01)
*F01L 1/344* (2006.01)

(56) References Cited

U.S. PATENT DOCUMENTS

| | | | | |
|---|---|---|---|---|
| 5,181,485 | A | 1/1993 | Hirose et al. | |
| 6,003,395 | A * | 12/1999 | Rogg | B60W 10/11 324/207.2 |
| 7,706,955 | B2 * | 4/2010 | Ichimoto | F02D 29/02 123/90.17 |
| 2003/0051683 | A1 * | 3/2003 | Okamoto | F02B 75/221 123/90.31 |
| 2022/0298932 | A1 * | 9/2022 | Mariotti | F01L 1/02 |

* cited by examiner

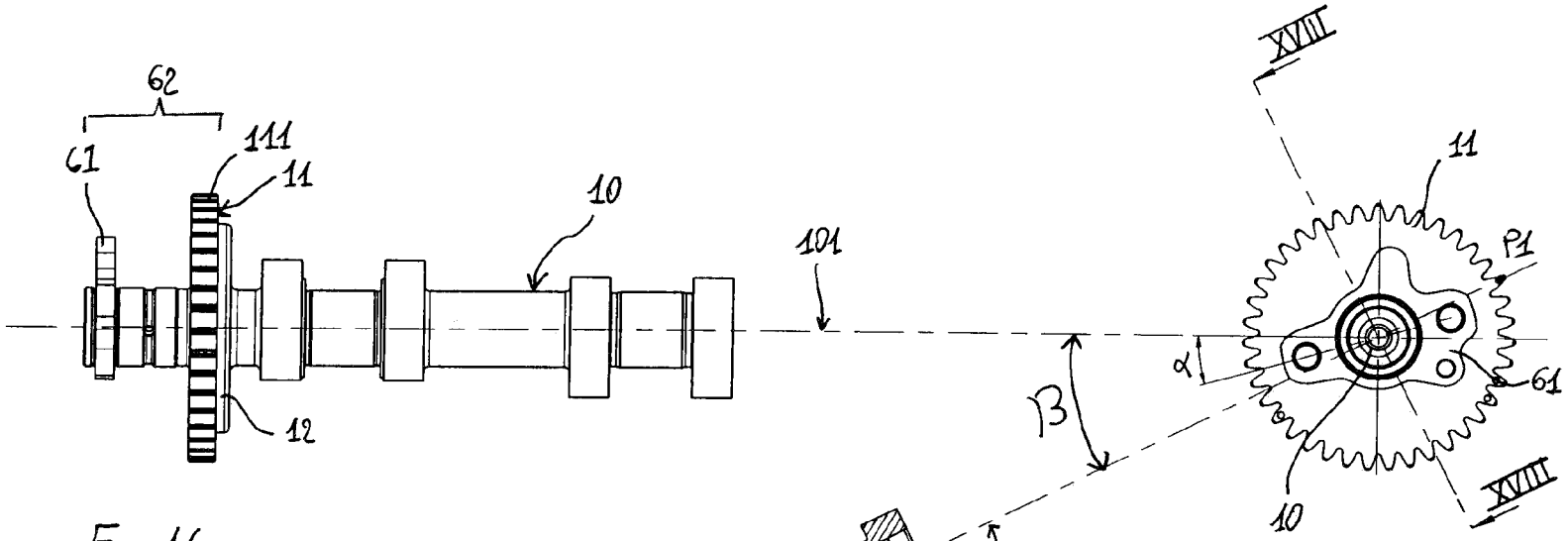
Fig. 16
Fig. 17
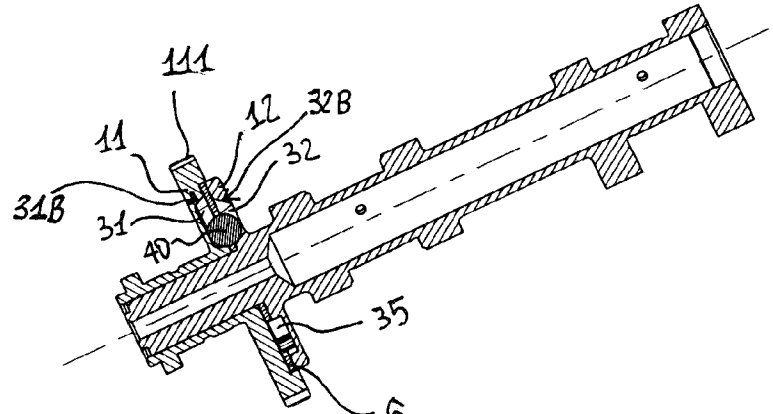
Fig. 18

INTERNAL COMBUSTION ENGINE WITH CAMSHAFT VALVE PHASE VARIATION DEVICE

CROSS REFERENCE TO RELATED APPLICATIONS

This application claims benefit under 35 U.S.C. § 371 to international application No. PCT/IB2020/058455 filed on Sep. 11, 2020, which claims priority to French application No. IT 102019000016283 filed on Sep. 13, 2019, the contents of which are incorporated by reference in their entireties.

FIELD OF THE INVENTION

The present invention relates to the field of manufacturing vehicles having a ridable seat, this term generally meaning a motorcycle or motor vehicle having two, three or four wheels, mainly intended to transport people. The present invention particularly relates to a combustion engine for a vehicle having a ridable seat provided with a camshaft for controlling a plurality of (suction or relief) valves and a device for changing the phase of said camshaft, i.e. of said valves, with respect to the drive shaft.

BACKGROUND ART

As known, an internal combustion engine for a vehicle having a ridable seat comprises a drive shaft the rotation of which is caused by the movement of the pistons in the combustion chamber of the cylinder. The engine also comprises one or more suction valves for introducing an air-fuel mixture into the combustion chamber, and one or more relief valves for discharging combustion gases. The suction valves and the relief valves are controlled by respective camshafts mechanically connected to the drive shaft, through a distribution system which typically comprises gears, belts, or chains. The rotation movement of the camshafts through the distribution system therefore is synchronized with that of the drive shaft. The term "timing" normally means the moment in which the opening and the closing of the suction and relief valves occurs with respect to a predetermined position of the piston. In particular, the opening advance (or delay) angle is considered with respect to the BDC (bottom dead center) and the closing advance (or delay) angle is considered with respect to the UDC (upper dead center) in order to define the timing. The advance angle is defined as the moment in which the valve reaches the complete open/closed position, ending the stroke thereof. Therefore, the advance angle values cause the instants in which the valve starts its opening motion (from completely closed) or closing motion (from completely open).

It is just as known that for a time interval, i.e. for a given rotation angle of the drive shaft, the suction valves and the relief valves are simultaneously open. This interval is referred to as a "crossing angle" and is the step in which the exhaust gases quickly leave the combustion chamber, inducing a suction which allows to increase the suction of fresh gases. The timing of the suction valves and the relief valves therefore causes the crossing angle value.

It is just as known that the value of the crossing angle causes various benefits according to the rotation speed of the drive shaft. An increased crossing angle value improves the performance at high speeds, but at low speeds causes poor efficiency of the engine in addition to an inefficient combustion, and therefore increased emissions. Contrarily, the engine loses efficiency at high rotation speeds if the crossing angle is quite curbed.

With respect to the above, various technical solutions have been proposed to change the timing of the suction valves and/or the relief valves, i.e. to change the value of the crossing angle of the valves, as a function of the rotation speed. U.S. Pat. No. 9,719,381 describes one of these technical solutions. Specifically, U.S. Pat. No. 9,719,381 describes an engine in which the distribution system is of the DOHC (double overhead camshaft) type comprising two camshafts, one intended to control the suction valves and the other the relief valves, which camshafts are arranged above the engine head. The distribution system comprises a driving gearwheel which is integral with the drive shaft. The three (driving and driven) wheels are connected by a driving belt. Each of the driven wheels is mounted to the corresponding camshaft close to an end thereof and so as to allow a relative rotation of the camshaft with respect to the wheel itself.

A device for changing the timing of the corresponding valves is provided for each of the camshafts. The driven wheel of the distribution system for each camshaft is part of said device, together with a guide element keyed, through a grooved profile coupling, onto said end of the camshaft so as to take a position adjacent to the driven wheel, whereby one side of the driven wheel faces a side of the guide element. Drive elements of the motion in the form of balls are interposed between the driven wheel and the guide element. Each drive element is partially accommodated in a track defined on said side of the driven wheel and partially on a corresponding track defined on said side of the guide element. The tracks of the driven wheel have an inclination, assessed on a plane orthogonal to the rotation axis of the camshaft, which is different from that of the tracks defined on the guide element. Therefore, each drive element is accommodated between two only partially facing tracks. Moreover, the related tracks for both components (driven wheel and guide element) have a curved profile assessed on a radial sectional plane.

The device described in U.S. Pat. No. 9,719,381 further comprises thrust means which act on the guide element, axially pushing it against the driven wheel. The rotation of the drive shaft is transmitted to the corresponding driven wheel mounted on the corresponding camshaft through the above-mentioned distribution system. The rotation motion of the driving element is transferred to the camshaft by the drive elements. As the rotation speed increases, the centrifugal force pushes the drive elements along the tracks towards the outside, i.e. away from the rotation axis of the camshaft. Due to the shape of the tracks, the guide element axially moves while undergoing a relative rotation with respect to the driven wheel. This rotation results in a relative rotation of the camshaft with respect to the driven wheel, and therefore in a change of the timing of the corresponding valves.

Technical solutions similar to that described above are also described in JP20100317855, JP2009185656 and JP 5724669. Although they achieve the preset functionality, these technical solutions, and others which are conceptually similar, have certain drawbacks. The main one is detected in the complexity characterizing the components which interact to achieve the phase change.

In particular, an increased number of balls is used in these known solutions, which results in lengthy and burdensome processing of the two components (the driven wheel actuated by the distribution system and the guide element keyed onto the driven shaft) to define the respective tracks which support the balls and define the guide thereof for the timing change. The employment of an increased number of balls is dictated by the need to ensure the correct drive of the rotation of the components, which suffers from existing clearances between the balls and tracks. Such clearances also affect the movement of the balls along the tracks, and therefore the relative rotation between the two components which support the balls themselves.

In addition to the increased number of tracks, it is found how the profile of the surfaces of the same balls also affects the times, and therefore the processing costs, of the two components forming the phase changer device. As indicated above, the balls have a curved profile for each component in order to ensure an axial movement of the guide element with respect to the driven wheel.

Another limitation of the solution described is found in the fact that the feature of the phase change strictly depends on the sizes and shape of the tracks and on the number of drive elements. Therefore, if such a feature is to be changed, there in fact is a need to replace the components of the phase changer (the driven wheel actuated by the distribution system and the guide element keyed onto the driven shaft) with others which are conveniently configured and capable of achieving the different phase change. In fact, a modification of the phase change feature with the known solutions requires a different design of the phase changer components, thus being a significantly burdensome operation.

SUMMARY OF THE INVENTION

Therefore, it is the main task of the present invention to provide a combustion engine for a vehicle having a ridable seat which allows to overcome the above-indicated drawbacks. Within the scope of this task, it is a first object of the present invention to provide a combustion engine provided with a device for changing the timing of a camshaft in which such a device requires a relatively contained number of drive elements. It is another object of the present invention to provide an engine in which the components of the timing changer device have a simplified shape and are easy to manufacture. It is still another object of the present invention to provide an engine in which a possible modification of the feature of the phase change may be actuated quickly and at highly competitive costs.

Not least object of the present invention is the provision of an engine the timing changer device of which is reliable and easy to manufacture at competitive costs. The Applicant has ascertained that the above-mentioned task and objects may be achieved by introducing retaining means in the device intended to change the camshaft timing, which retaining means oppose the movement of the drive elements caused by the centrifugal force so as to cancel the existing clearances between the same drive elements and the tracks defined on the components of the device. More precisely, the above-mentioned task and objects are achieved by an internal combustion engine for a motor vehicle having a ridable seat, in which said engine comprises a drive shaft and a camshaft which controls a plurality of opening or relief valves, in which said engine comprises a device for changing the timing of the valves with respect to said drive shaft. According to the invention, the device comprises:

- a first disc idly mounted to said camshaft and so as to coaxially rotate about the same rotation axis as said camshaft, in which said first disc comprises a first side defining first tracks, each of which extends along a first reference direction;
- a second disc which is integral with the camshaft and comprises second tracks which face the first side of the first disc, in which each of said second tracks partially faces a corresponding first track of the first disc, and in which each of said second tracks extends along a second reference direction which is tilted with respect to the first direction;
- a plurality of drive elements for transmitting the motion between the first disc and the second disc, in which the drive elements are interposed between the discs and in which each drive element is accommodated between corresponding two of said partially facing tracks, and in which as the centrifugal force caused by the rotation speed of the camshaft changes, each of the drive elements moves along the corresponding partially facing tracks between a first reference position and a second reference position which are close to and far from the rotation axis of the camshaft, respectively;
- axial preloading means which act on the first disc, thus preventing a translation of the first disc with respect to the second disc along a direction parallel to the rotation axis of the camshaft.

The engine according to the invention is characterized in that the timing changer device comprises means for retaining the drive elements, in which said retaining means are operatively interposed between the two discs and exert a force which tends to oppose the movement of the drive elements towards the second reference position.

According to a possible embodiment, the engine comprises a distribution system for rotating the first disc; such a distribution system comprises a first distribution wheel keyed onto the drive shaft, a second distribution wheel which is integral with the first disc, and a flexible drive element which connects the two distribution wheels so that the rotation of the drive shaft is transferred to the first disc.

According to one embodiment, the engine comprises a sleeve body which is made in one piece with the first disc, in which the first disc is defined at a first end of the sleeve body, which comprises a flange portion defined at a second end, said second distribution wheel being connected to the flange portion of the sleeve body.

In a possible embodiment, said preloading means comprise a cup spring which acts on said flange portion so as to push the sleeve body towards the second disc, in which the cup spring is interposed between the flange portion and an adjusting screw which is coaxially screwed to an end of the camshaft so that the rotation of the screw causes a compression of the cup spring.

According to a preferred embodiment, the first disc comprises a ring gear for transmitting the rotation motion to a further camshaft or for receiving the rotation motion from a further camshaft, in which said further camshaft is different from that to which said first disc is mounted.

According to a possible embodiment, the retaining means comprise:

- a discoidal element interposed between the first disc and the second disc so as to freely rotate with respect to each of the discs, in which the discoidal element defines at least one opening crossed by the drive elements, and in which said at least one opening defines a plurality of guide surfaces, each of which comes into contact with a corresponding one of the drive elements during the movement between said reference positions;
- elastic means interposed between one of said discs and said discoidal element so as to exert a force on said discoidal element which keeps each of the guide surfaces in contact with the corresponding one of said drive elements.

The discoidal element preferably comprises an opening for each of the drive elements, in which each opening defines a guide surface which at least partially extends according to a third reference direction which is tilted with respect to said first direction and second direction.

The elastic means preferably comprise an elastic spring for each opening, in which each elastic spring rests, with a first end thereof, on a first abutment surface defined by the discoidal element, and with a second end thereof, which is opposite to the first end, on a second abutment surface defined by the second disc.

According to a possible embodiment, for each spring, the corresponding first abutment surface is defined by a portion which axially emerges from a first side of the discoidal element facing the second disc, in which, for each spring, the second abutment surface instead is defined by a first side of a seat defined on a side of the second disc facing the discoidal element, and in which, for each spring, said axial portion is placed in the seat in a position close to a second side of said seat.

According to a preferred embodiment, said drive elements are balls made of metal material.

According to a further embodiment, the first tracks of the first disc have a tapered shape in opposite direction to the second disc, and the second tracks of the second disc have a tapered shape in opposite direction to the first disc.

LIST OF DRAWINGS

Further features and advantages of the invention will become better apparent from a discussion of the following detailed description of some preferred, but not exclusive, embodiments of the engine according to the present invention, shown by way of non-limiting example, with the aid of the accompanying drawings, in which:

FIGS. 16 and 17 are two further views, from different observation points, of the camshaft of FIGS. 11 and 12, in a first operating configuration;

FIG. 18 is a sectional view according to sectional line XVIII-XVIII in FIG. 17;

The same numerals and reference letters in the Figures identify the same elements or components.

DETAILED DESCRIPTION

Figure 2:
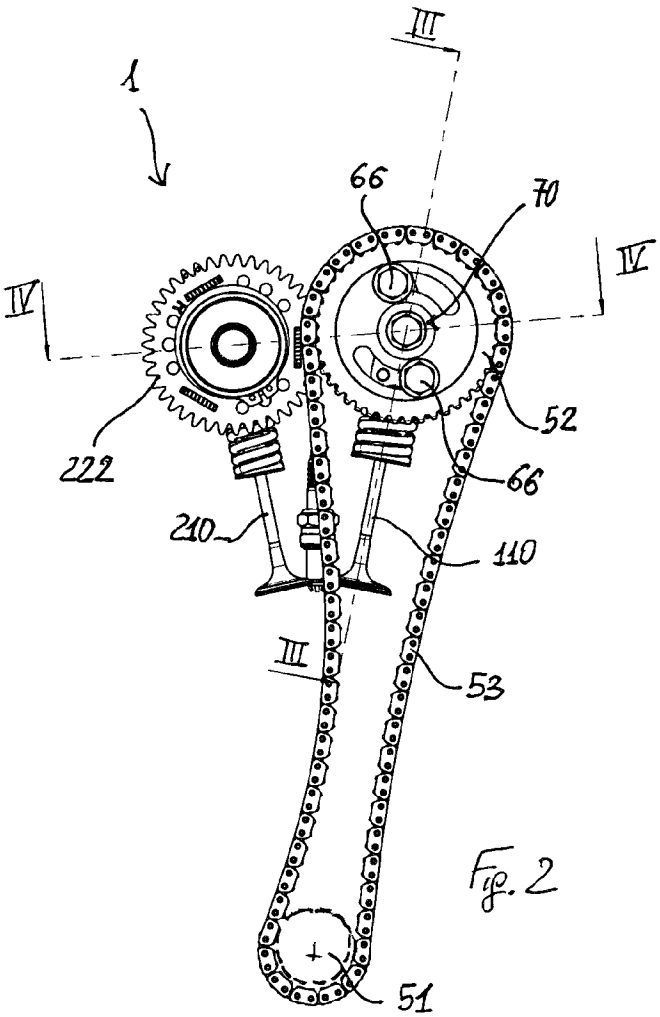
FIGS. 1 and 2 are a diagrammatic perspective view and a front diagrammatic view, respectively, of a group of components of an engine according to the present invention.
Figure 1:
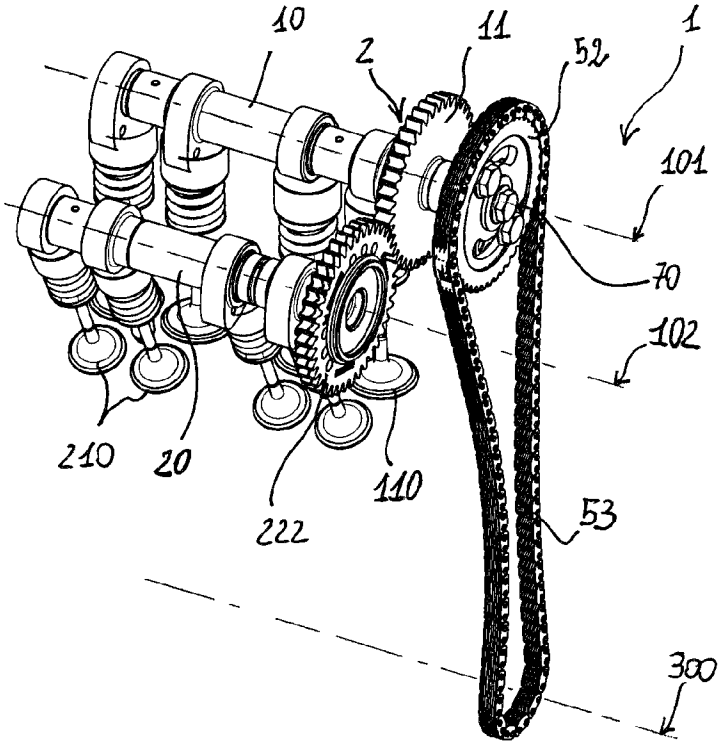

With reference to the mentioned Figures, the present invention relates to a combustion engine for a motor vehicle having a ridable seat, this term in general meaning a motorcycle or motor vehicle having two, three or four wheels, mainly intended to transport people. FIG. 1 diagrammatically shows certain parts of an internal combustion engine 1 according to the invention, while the other parts, which are not essential to comprehending the present invention, are not shown for reasons of increased illustrative clarity.

Engine 1 according to the invention comprises a first camshaft 10, rotating about a first rotation axis 101, and a second camshaft 20, rotating about a second rotation axis 102, for controlling a plurality of suction valves 110 and a plurality of suction valves 210, respectively. Engine 1 also comprises a device 2 for changing the timing of the valves 110, 210 of one of the two camshafts 10, 20 with respect to the drive shaft. The drive shaft is not shown in the accompanying Figures, rather is diagrammatically indicated by an axis having reference numeral 300. Device 2 is also indicated by the term "phase changer 2" or "phase changer device 2" in the continuation of the description.

In the embodiment shown in FIG. 1, device 2 is applied to the first camshaft 10 to change the phase of the suction valves 210 with respect to the drive shaft 300. However, device 2 could be operatively associated with the second camshaft 20 to change the phase of the relief valves 220. Moreover, according to a further possible embodiment of the invention, engine 1 could comprise a first device for changing the phase of the suction valves and a second device for changing the phase of the relief valves, which phase changer devices are operatively associated with the first camshaft and the second camshaft, respectively.

The phase changer device 2 is described in the following description while mainly referencing the first camshaft 10, which is also indicated by the more general term "camshaft 10". In reference to the components of the phase changer 2, the terms "axial" and "axially" refer to distances, thicknesses and/or positions assessed along the rotation axis 101 of the first camshaft 10.

According to the invention, the phase changer 2 comprises a first disc 11 mounted idly and coaxial to the camshaft 10 so that the first disc 11 and camshaft 10 rotate about the same rotation axis 101. Being "idle", the first disc 11 keeps a degree of freedom of rotation with respect to camshaft 10, and vice versa. Thereby, camshaft 10 can rotate with respect to the first disc 11 about the first rotation axis 101 so as to change the timing of the valves, as better described below.

Figure 25:
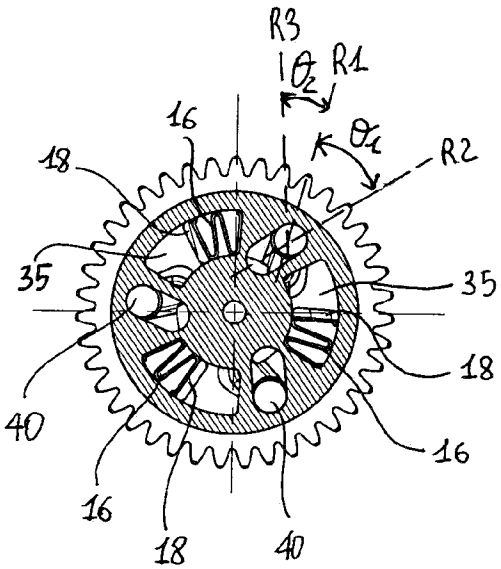
FIGS. 24 and 25 are a side view and a sectional view, respectively, of the camshaft in FIGS. 21 and 22, in which said sectional view in FIG. 25 is defined according to sectional line XXV-XXV in FIG. 24.
Figure 24:
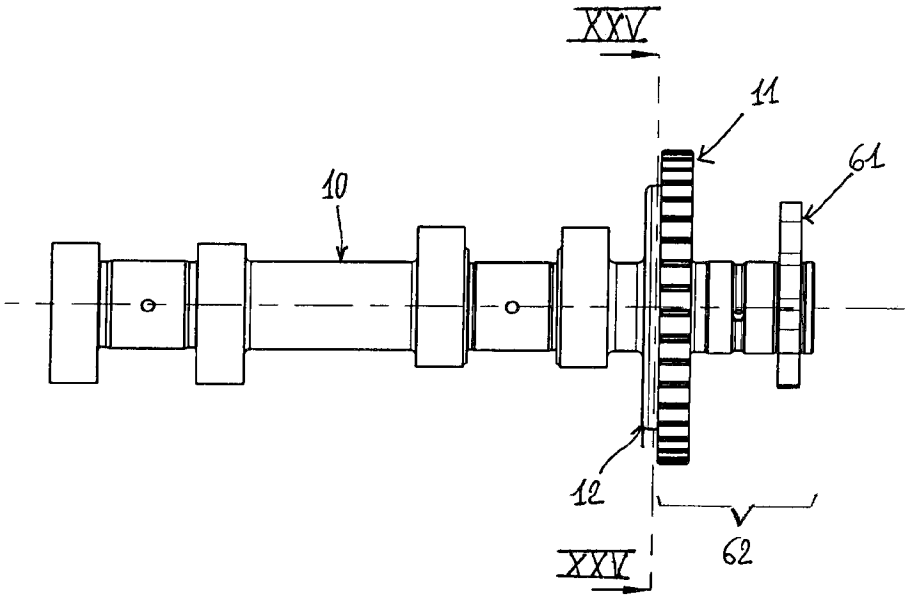
Figure 26:
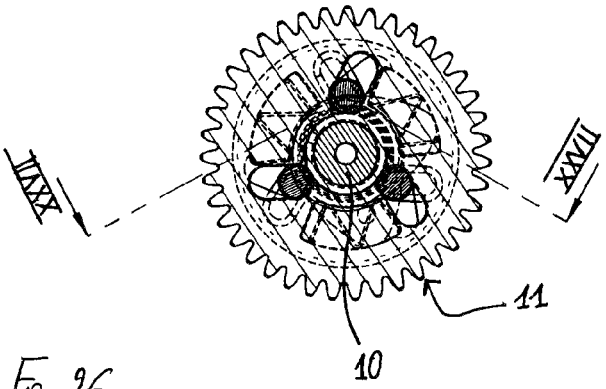
FIGS. 26 and 27 are a further side view and a sectional view, respectively, of the camshaft in FIGS. 21 and 22, in which the sectional view in FIG. 27 is defined according to sectional line XXVII-XXVII in FIG. 26.

The first disc 11 comprises a first side 11A on which first tracks 31 are defined, in particular slot-shaped grooves (see, for example FIG. 8), hereinafter indicated as first grooves 31. Each of them extends along a first straight reference direction (indicated by R1 in FIGS. 13 and 25). Preferably, but not exclusively, there are three first grooves 31 and they are distributed so that the respective straight reference lines R1 identify an equilateral triangle with the mutual intersection thereof. In the possible, but not exclusive, embodiment shown in the Figures, the first grooves 31 are blind, i.e. they comprise a bottom surface which delimits the extension thereof in axial direction. In an alternative embodiment (not shown in the Figures), the first grooves 31 could pass through the axial thickness of the first disc 11.

The phase changer device 2 also comprises a second disc 12 connected to camshaft 10 so as to rotate integrally thereto about the first rotation axis 101. For this purpose, according to a preferred embodiment shown in the Figures, the second disc 12 is made in one piece with camshaft 10. Alternatively, the second disc 12 could be made independently from camshaft 10 and then rigidly keyed thereto (for example, through a key connection).

In any case, the second disc 12 also comprises a plurality of second tracks, in particular slot-shaped grooves, hereinafter indicated as second grooves 32, which extend along a second reference direction (indicated by R2 in the Figures). The second grooves 32 may be defined on one side 12A of the second disc 12 alone, i.e. according to a similar solution to that described above for the first disc 11, or alternatively axially pass through the thickness of the second disc 12, as in the solution shown in the Figures (see, for example FIGS. 6 and 8).

In any event, the two discs 11, 12 are axially placed on camshaft 10 and angularly arranged about the rotation axis 101 so that each of the second grooves 32 at least partially faces a corresponding one of said first grooves 31. Therefore, the number of the second grooves 32 preferably corresponds to those of the first grooves 31. Moreover, the second grooves 32 are defined so that the second direction R2 for each of them is tilted with respect to the first direction R1 of the corresponding first groove 31 which it partially faces. The different inclination of the reference directions R1 and R2 is clearly shown in FIG. 13.

For the purposes of the present invention, the term "slot" means a shape of the (first and second) grooves in which straight opposite stretches and two curved parts which are opposite and have the same radius of curvature are identified.

The phase changer 2 comprises a plurality of drive elements 40, each of which being interposed between the two discs 11, 12 indicated above. More precisely, each drive element 40 is accommodated between one of said first grooves 31 and a corresponding one of said second grooves 32 partially facing it. The drive elements 40 serve the purpose of transmitting the rotation motion from the first disc 11 to the second disc 12, i.e. to camshaft 10, which is integral with the second disc 12. According to the invention, the phase changer 2 comprises preloading means 70 configured to preclude an axial movement of the first disc 11 with respect to the second disc 12, and therefore so as to keep the drive elements 40 between the two discs 11, 12, each in the two grooves (first groove 31 and corresponding groove 32) in which it is accommodated. A possible embodiment of the preloading means 70 is described later.

Overall, the two discs 11, 12 and the drive elements 40 configure a centrifugal phase changer 2. Therefore, following the increase of the centrifugal force caused by the increase of the rotation speed, each of the drive elements 40 moves outwardly (i.e. moving away from the rotation axis 101) along the two grooves 31, 32 overall defining a seat in which the same element is accommodated. In particular, such a movement occurs between a first reference position, which is close to the rotation axis 101, and a second reference position, which is far from the rotation axis 101. Each of the (first and second) positions indicated for each of the drive elements 40 preferably is defined by a corresponding end of the grooves 31, 32 in which the drive element 40 is accommodated. As described better later, upon a different inclination of the second direction R2, referring to the second grooves 32, with respect to the first direction R1, referring to the first grooves 31, the movement of the drive elements 40 from the first reference position to the second reference position causes a relative rotation of the second disc 12 (and therefore of camshaft 10) with respect to the first disc 11. Such a relative rotation translates into a change of the timing of the valves 110 of camshaft 10 with respect to the drive shaft 300.

The present invention is characterized in that said phase changer 2 comprises means 6 for retaining the drive elements 40 interposed between the first disc 11 and the second disc 12. Such retaining means 6 act on the drive elements 40, exerting on each of them a force which tends to push the drive element 40 towards the first position indicated above (i.e. towards the rotation axis 101). It has been shown how the employment of retaining means 6 allows to recover the clearances between the drive elements 40 and the grooves 31, 32, thus making the transmission more efficient. With respect to centrifugal changer of the known type, the employment of the retaining means 6 allows to reduce the number of drive elements 40, and therefore of the grooves 31, 32. Overall, this results in a simplification of the structure of the discs, and therefore in a reduction of the costs associated with manufacturing and assembling the engine.

According to a possible embodiment shown in FIGS. 1 to 4, the rotation of the first disc 11 is caused by a distribution system 5 directly actuated by the drive shaft 300. Such a distribution system 5 comprises a first distribution wheel 51, keyed onto the drive shaft 300 (indicated by a dashed line in FIG. 2), a second distribution wheel 52 which is integral with the first disc 11, and a flexible drive element 53 (in the form of chain or belt) which connects the two distribution wheels 51, 52 so that the rotation of the drive shaft 300 is transferred to the first disc 11 of the phase changer 2.

It is worth noting that the distribution system 5 could be configured to transmit the rotation to the second camshaft 20 as well. As indicated above, in a possible embodiment, a further device (similar to that described above for the first shaft) for changing the phase of the relief valves could be associated with the second camshaft 20. Therefore, the first disc of this further device could also be actuated by the distribution system of the engine.

Figure 3:
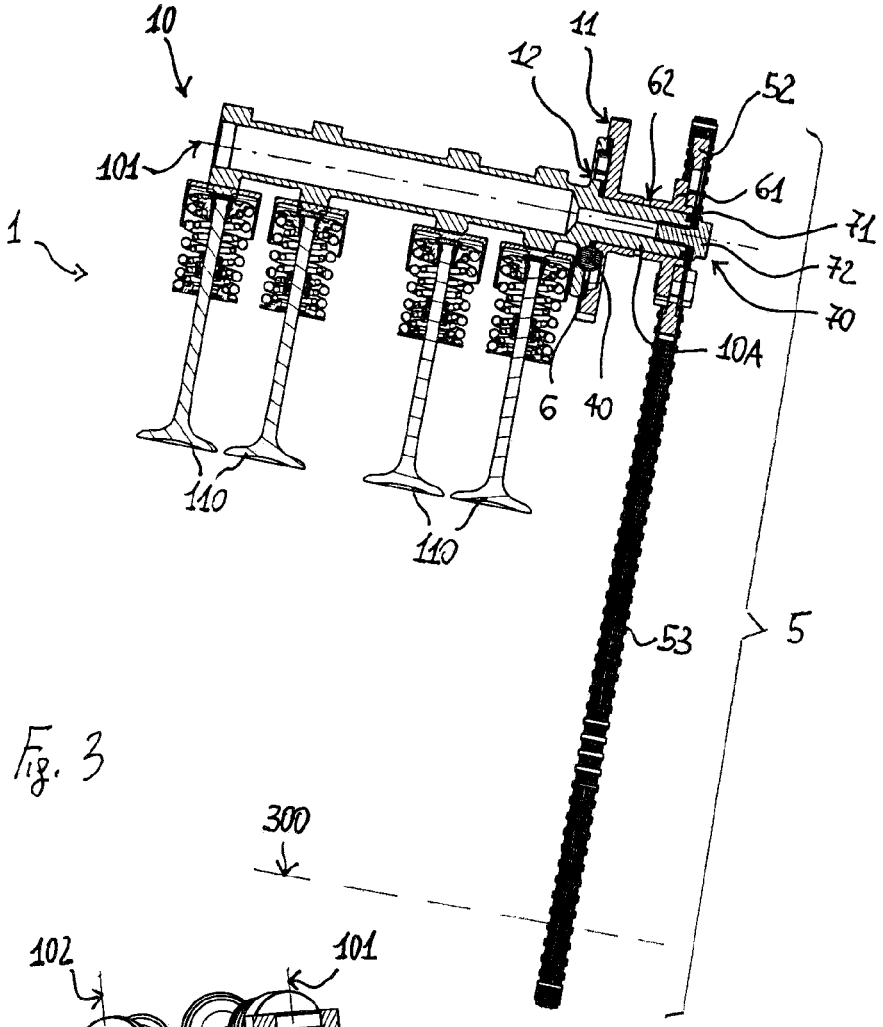
FIGS. 3 and 4 are sectional views according to the sectional line in FIG. 2 and the sectional line in FIG. 4, respectively.
Figure 4:
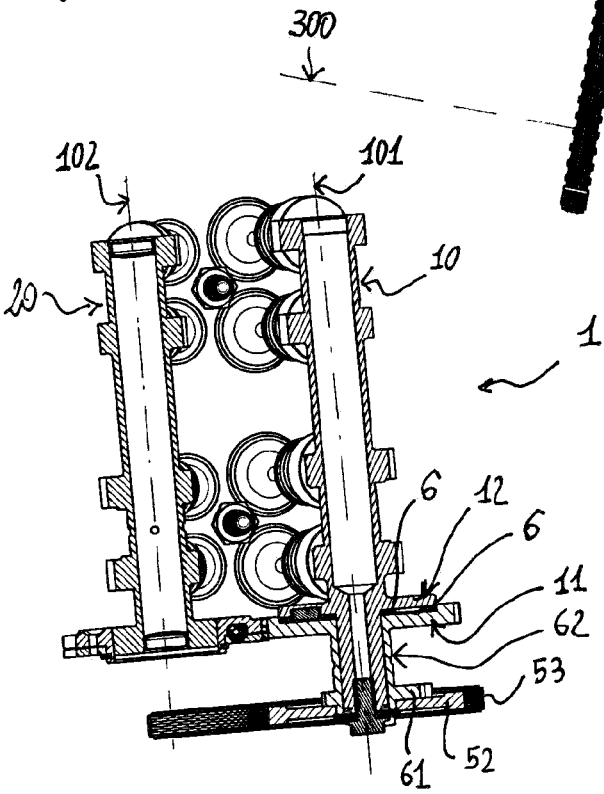

According to the embodiment (shown, for example in FIG. 4), the second distribution wheel 52 is connected to a flange portion 61 of a sleeve body 62 made in one piece with the first disc 11. The first disc 11 is particularly defined at a first end of the sleeve body 62, opposite to a second end defining the flange portion 61. The second distribution wheel 52 preferably is connected to the flange portion 61 through screw connection means 66. With reference to FIGS. 3 and 4, the sleeve body 62 preferably is mounted to an end part 10A of camshaft 10 so that the first disc 11 faces the second disc 12 for the purposes already indicated above.

In a possible embodiment thereof, the above-indicated preloading means 70 comprise a cup spring 71 which acts on the flange portion 61 of the sleeve body 62 so as to push the latter towards the second disc 12. The cup spring 71 is interposed between the flange portion 61 and an adjusting screw 72 which coaxially screws to the end of camshaft 10, about which the flange portion 61 is arranged. Closing screw 72 results in the compression of the cup spring 71, and therefore in an axial force which opposes the first disc 11 from moving away from the second disc 12.

Other embodiments of the preloading means which are structurally different but functionally equivalent to that described above are in any case considered to fall within the scope of the present invention.

According to a preferred embodiment shown in the Figures, the first disc 11 comprises ring gear 111 for transmitting the rotation motion to a further camshaft, which is different from that to which the same first disc 11 is mounted. The ring gear 111 preferably is made in one piece with the first disc 11 so that the same takes the configuration ascribable to a gearwheel.

In the case shown in FIGS. 1 to 4 in which i.e. the phase changer device 2 is operatively associated with the first camshaft 10, the ring gear 111 meshes a gearwheel 222 which integrally rotates with the second camshaft 20 about the rotation axis 102 thereof. In an alternative embodiment, in which changing the timing also for the relief valves could instead be provided, in addition to the suction valves, the gearwheel 222 could be integral with a first disc of a further changer associated with the second camshaft 20.

Figure 10:
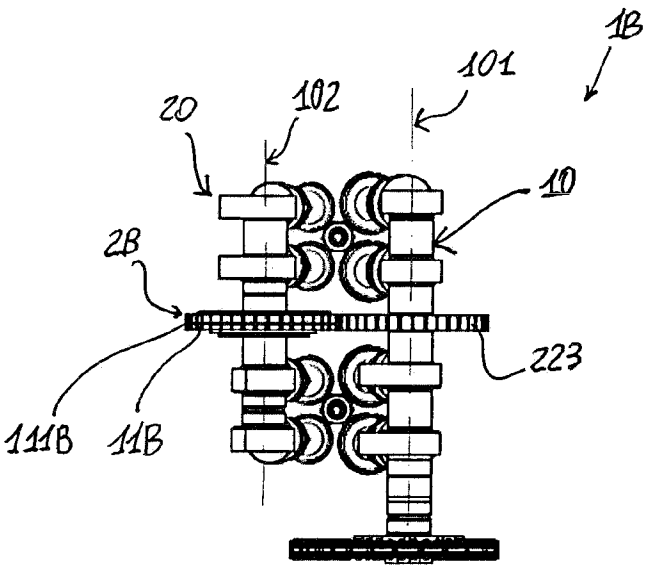
FIGS. 9 and 10 are two diagrammatic views from different observation points, of a possible embodiment of an engine according to the present invention.
Figure 9:
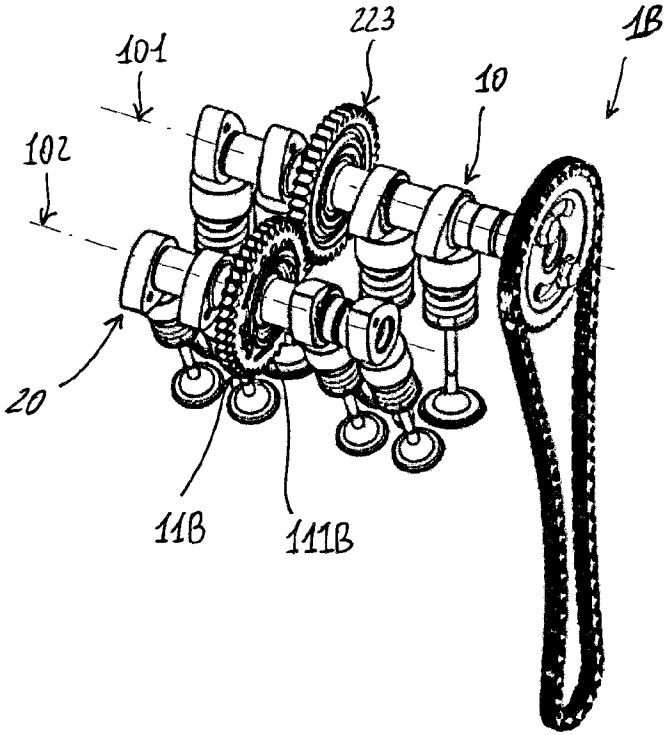

FIGS. 9 and 10 show a further embodiment of an engine (indicated by reference numeral 1B) according to the present invention, in which the second camshaft 20 comprises a phase changer device (indicated by reference numeral 2B) having the above-described technical features. Also in this case, a ring gear (indicated by 111B) which meshes with a gearwheel 223 which is integral with camshaft 10 is integral with the first disc (indicated by 11B) of device 2B. Thereby, the rotation of the first disc 11B is caused by the rotation of the first camshaft 10. In essence, the ring gear 111B and gearwheel 223 define a return drive of the motion from the first camshaft 10 to the ring gear 111B. Therefore, in general, the ring gear 111-111B of the first disc 11, 11B may also be defined to receive the rotation motion from a further camshaft which is different from that to which the same first disc 11 is mounted.

For the purposes of the present invention, it is worth noting that the first disc 11 performs the function of "driving disc" of the second disc 12. In any event, the rotation of the first disc 11 is caused by a component which is external to the camshaft (10 or 20) to which the same driving disc is mounted. In the embodiment shown in FIGS. 1 to 4, the first disc 11 is indeed actuated by the distribution system 5, while in the embodiment in FIGS. 9 and 10, the first disc 11 is actuated through the return drive defined by the wheels 111B and 223.

It is also worth noting how the embodiment in FIGS. 1 and 4 is particularly advantageous because in addition to being part of the phase changer device 2, the first disc 11 advantageously is used as means for transmitting the motion to the second camshaft 20. With respect to the prior art, in particular with respect to the description in U.S. Pat. No. 9,719,381, this technical solution allows to simplify the distribution system, and therefore reduce the components of the engine used for timing the valves.

Figure 6:
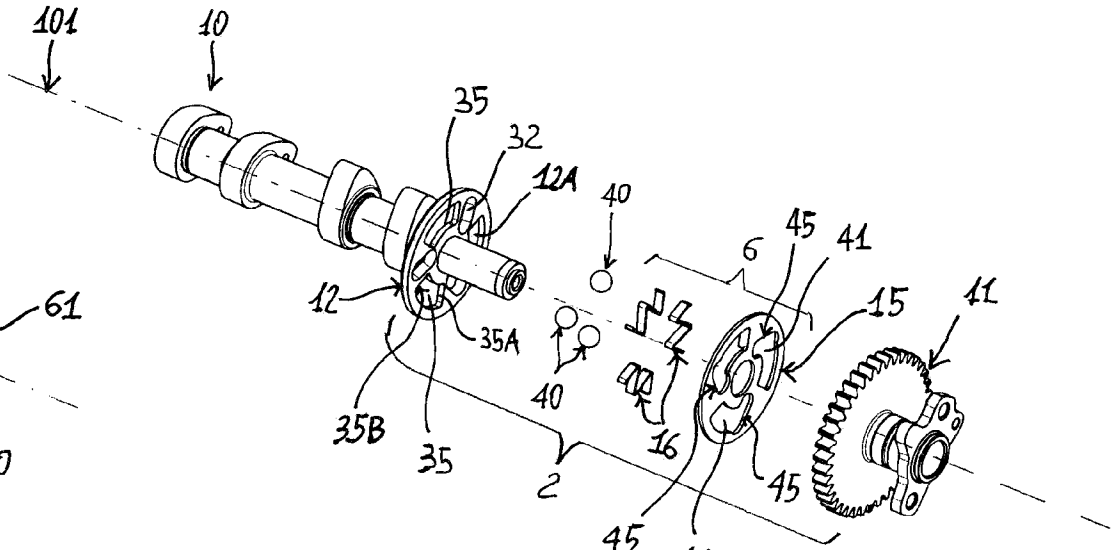
FIGS. 5 and 6 are a perspective view and an exploded view, respectively, of a group of components of the engine according to the present invention, from a first observation point.
Figure 5:
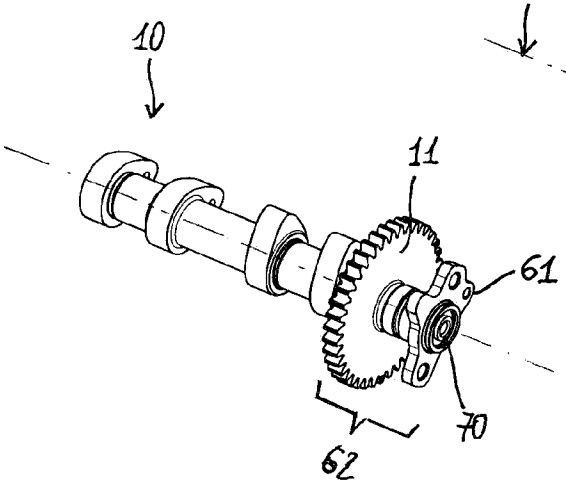
Figure 8:
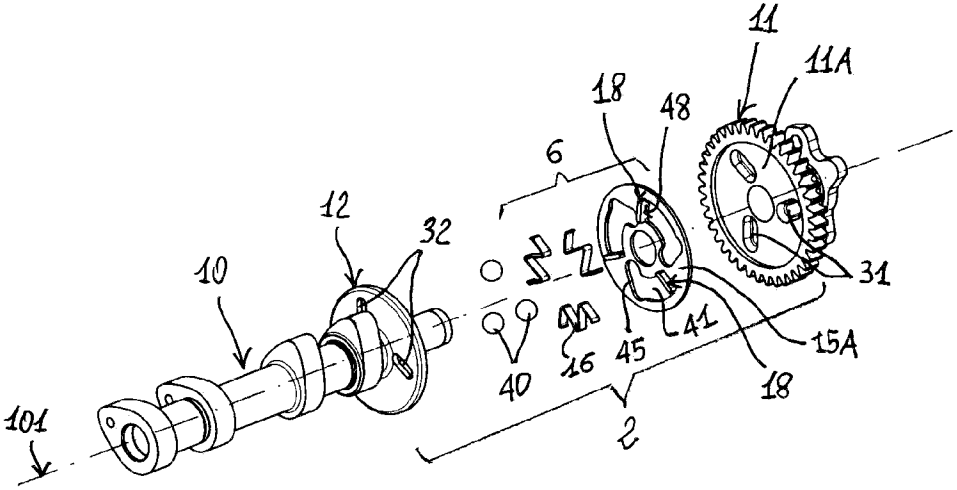
FIGS. 7 and 8 are a further perspective view and an exploded view, respectively, of the group of components shown in FIGS. 5, and 6, from a second observation point substantially opposite to said first observation point.
Figure 7:
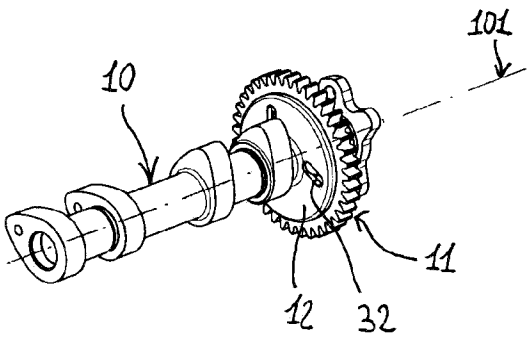

According to a preferred embodiment shown in FIGS. 6 and 8, the retaining means 6 of the phase changer device 2 comprise a discoidal element 15 mounted to camshaft 10 and interposed between the first disc 11 and the second disc 12 so as to be free to rotate with respect to each of the two discs 11, 12. The discoidal element 15 defines one or more openings 41 passing through the whole axial thickness thereof, which are crossed by one or more of said drive elements 40. Said one or more openings 41 define, with a portion of the profile thereof, a plurality of guide surfaces 45, each of which comes into contact with a corresponding drive element 40 during the movement thereof between the two reference positions indicated above, caused by the centrifugal force.

In this embodiment, the retaining means 6 also comprise elastic means (springs 16) interposed between one of the two discs 11, 12 and the discoidal element 15 so as to exert a force on the discoidal element 15 which keeps each guide surface 45 in constant contact with the corresponding drive element 40. Due to the shape thereof and to the action of the elastic means 16, each guide surface 45 exerts an opposing action to the movement of the element itself on the corresponding drive element 40. This action allows to recover the existing clearances between the drive elements 40 and the grooves 31, 32 while stabilizing the movement of the same elements so as to ensure a stable operation of device 2.

In detail, the shape of each guide surface 45 also defines the timing changer law of the valves. In particular, the shape itself of the guide surfaces in the openings, i.e. the inner shape itself of the openings, may be adapted as a function of the type of engine to which it is applied, thus generating a different timing of the valves. Indeed, the interposition of the disc with the openings creates a specific mechanical adjustment of the timing because the suitably shaped openings cause a law of movement of the balls, for example as a function of the revolution speed. For example, the opening may be shaped so that the balls are withheld stationary by the shape of the guide surfaces if a first revolution speed is not exceeded. Once such a rotation speed is exceeded, the balls instead move, so that a determined speed is always kept as a function of the shape of the guide surface, and so on. Multiple guide surfaces may be obtained in a single opening, a plurality of guide stretches, each defining a respective law to have the balls follow so as to therefore cause a dedicated change of the timing.

This system is quite evolved with respect to systems of the known art in which the timing is a direct and exclusive function of the type of spring and weight of the employed masses in contact with the springs.

In an embodiment, the discoidal element 15 comprises an opening 41 for each drive element 40. Each opening 41 defines a guide surface 45 substantially configured like a "half slot", this term meaning a shape which is missing one of the rectilinear stretches with respect to the "slot" shape. The slot shape is characterized by a third straight reference direction (indicated by R3) (parallel to the straight stretch of the shape) which is tilted with respect to the first direction R1 and the second direction R2, as can be deduced from the comparison between the sectional views 13 to 15. The elastic means preferably comprise an elastic spring 16 for each opening 41, and therefore for each drive element 40. Each elastic spring 16 rests, with a first end 16A thereof, on a first abutment surface 48 defined by the discoidal element 15, and with a second end 16B thereof, which is opposite to said first end, on a second abutment surface 49 defined by the second disc 12. Each spring 16 therefore is operatively placed between the discoidal element 15 and the second disc 12. Each spring 16 preferably remains at least partially accommodated in a part of the corresponding opening 41.

Again according to a preferred embodiment, for each spring, the corresponding first abutment surface 48 16 is defined by a portion 18 which axially emerges from a first side 15A of the discoidal element 15 facing the second disc 12. For each spring, the second abutment surface 49 16 instead is defined by a first side 35A of a seat 35 defined on side 12A of the second disc 12 facing the discoidal element 15 (see FIG. 6). For each spring, the axial portion 18 of the discoidal element 15 16 is placed in seat 35 in position close to a second side 35B, opposite to said first side 35A. Thereby, each spring 16 remains at least partially accommodated in the corresponding seat 35 defined in the second disc 12.

It has been shown how, in addition to allowing the positioning of each spring 16, this solution also advantageously facilitates the assembly operations of the phase changer device 45. Indeed, the opposite sides (35A and 35B) of seat 35 and the axial portions 18 as a whole define an advantageous system of physical references for the mutual positioning of the respective components.

In the possible, but not exclusive, embodiment shown in the Figures, seat 35 may axially pass through the whole thickness of the second disc 12. Alternatively, the seats 35 could be blind. The surfaces defining all the sides of seat 35 preferably extend axially.

According to a preferred embodiment of the invention, the drive elements 40 are balls made of metal material. Therefore, the term "balls 40" will also be used to mean the drive elements in the continuation. However, the possibility of using drive elements in the form of rollers instead of balls falls within the scope of the present invention.

According to one embodiment, the first grooves 31 of the first disc 11 have a tapered shape in the opposite direction to the second disc 12, while the second grooves 32 of the second disc 12 have a tapered shape in the opposite direction to the first disc 11. In essence, the related grooves 31, 32 for both discs 11, 12 have tilted sides 31B, 32B (i.e. which do not extend parallel axial) on which the corresponding ball 40 continuously rests.

Figures 21, 22, 23:
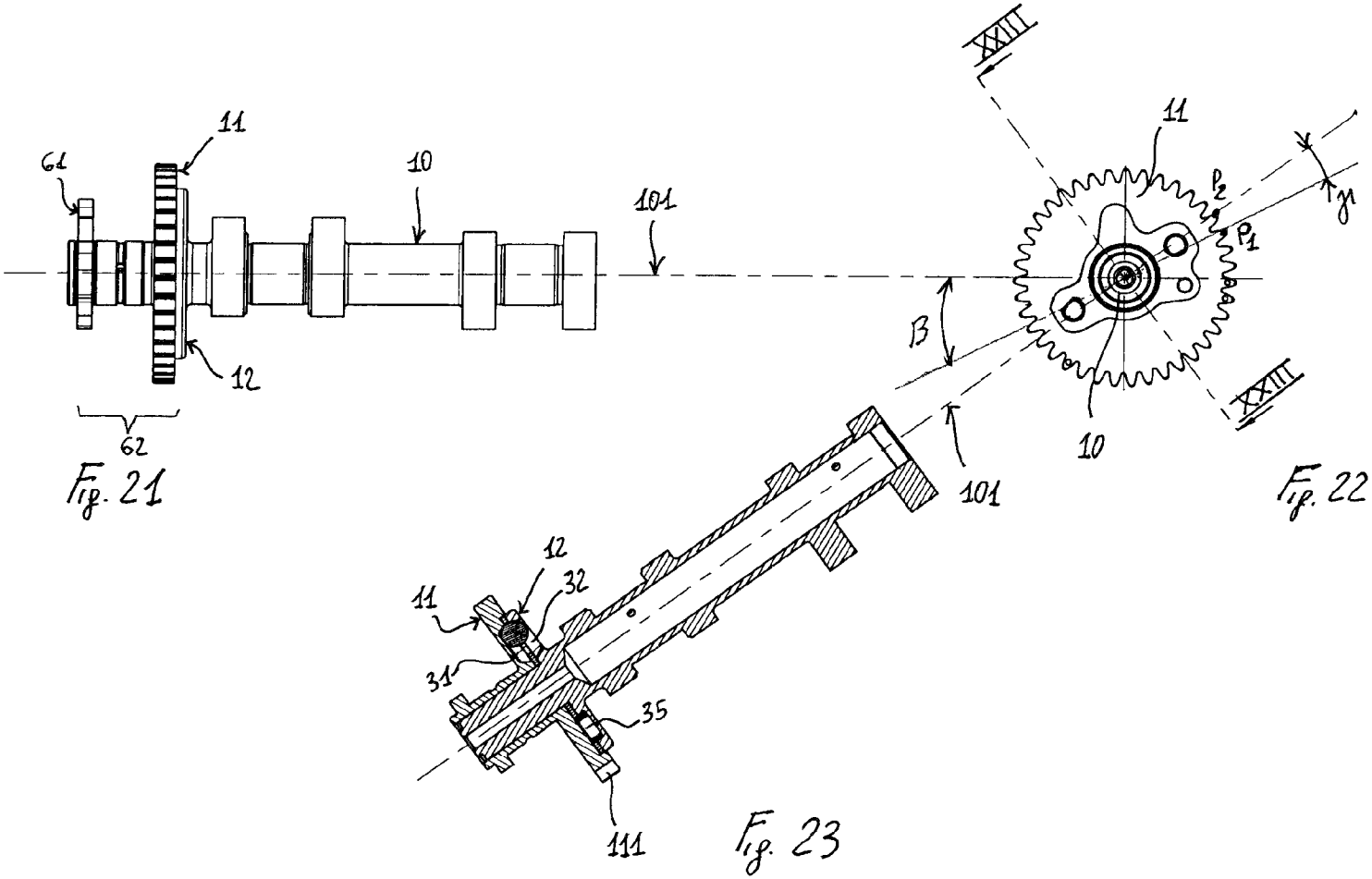
FIGS. 21 and 22 are two further views, from different observation points, of the camshaft in FIGS. 16 and 17, in a second operating configuration.
FIG. 23 is a sectional view according to sectional line XIII-XIII in FIG. 22.
Figure 27:
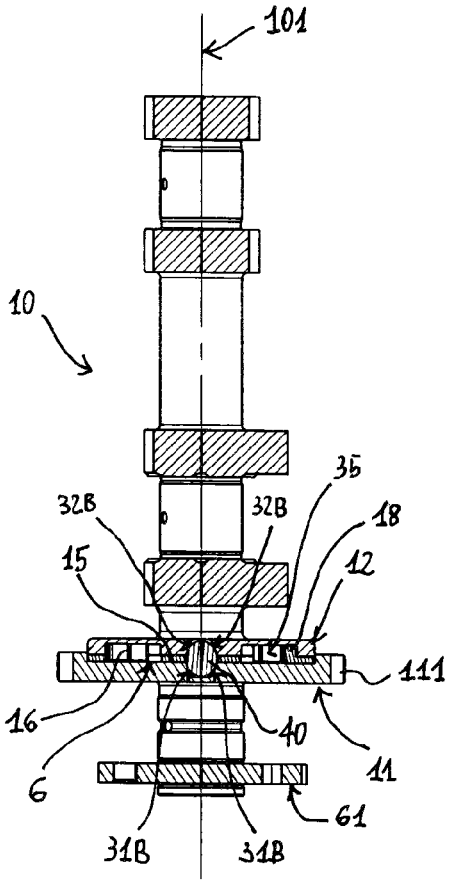

In this regard, FIG. 27 is a sectional view defined according to a broken sectional line. This Figure allows to see how the sides 31B of the first grooves 31 and the sides 32B of the second grooves 32 are in any case tapered irrespective of the orientation of the sectional line considered. As confirmation of this, FIGS. 18 and 23 are sectional views according to a radial sectional plane, i.e. containing the rotation axis 101 of camshaft 10. Also in this case, it is worth noting how the sides 31B, 32B of the grooves 31, 32 in any case are tilted so that each side rests on the corresponding ball 40. It can be further seen from the comparison between FIGS. 18 and 23 how the contact of the sides 31B, 32B with ball 40 remains constant, irrespective of the position taken by the latter.

Figure 12:
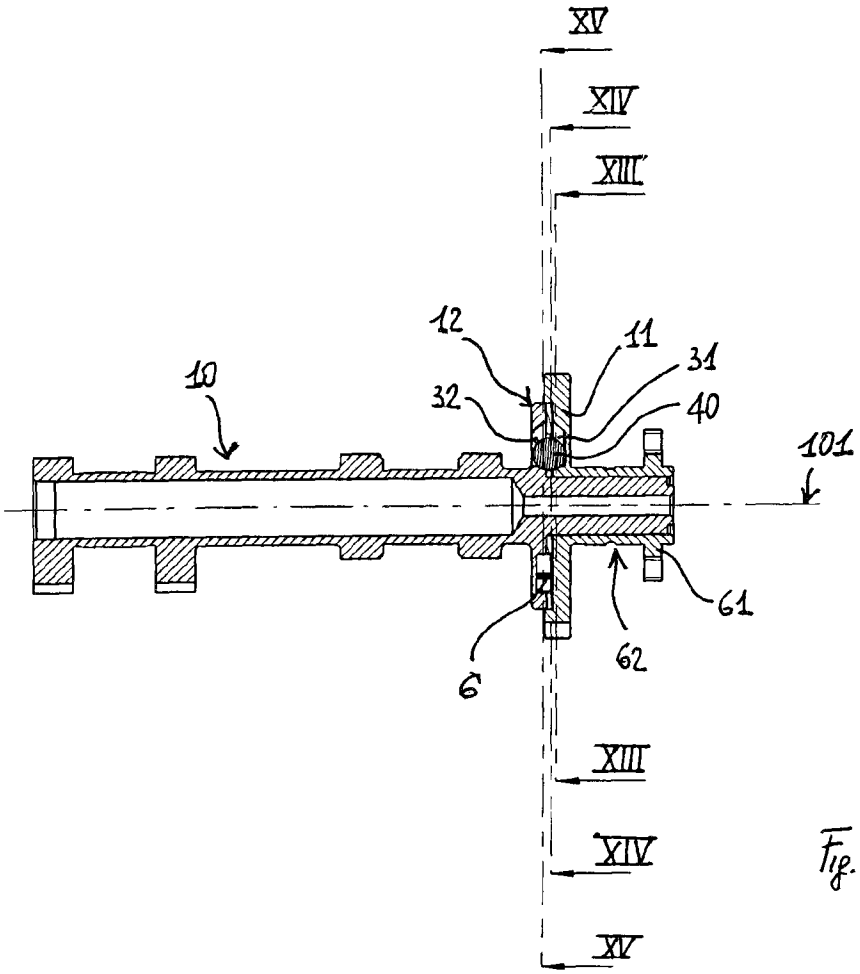
FIGS. 11 and 12 are a side view and a sectional view, respectively, of a camshaft of an engine according to the present invention, in which said sectional view in FIG. 12 is defined according to sectional line XII-XII in FIG. 11.
Figure 11:
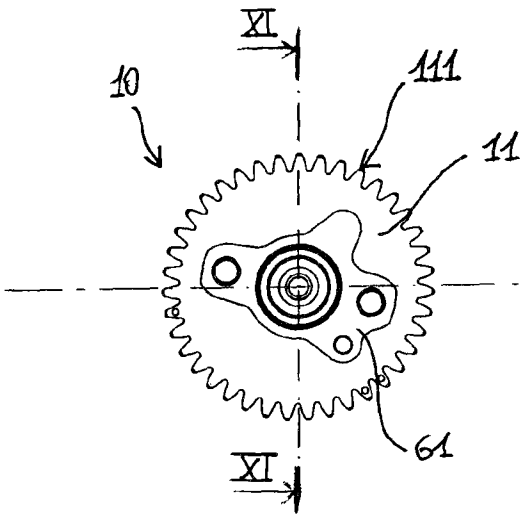
Figure 13:
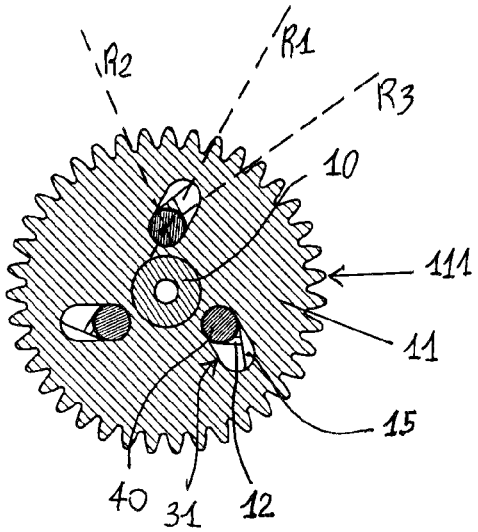
FIGS. 13, 14 and 15 are sectional views along sectional line XIII-XIII, along sectional line XIV-XIV, and along sectional line XV-XV, respectively, in FIG. 12.
Figure 14:
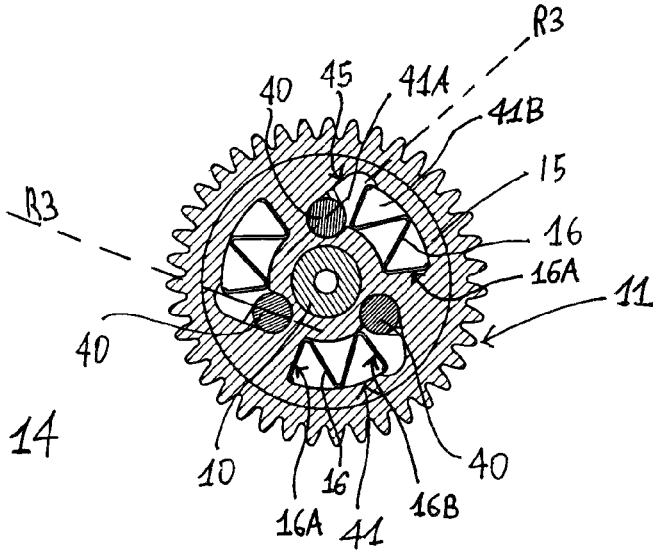
Figure 15:
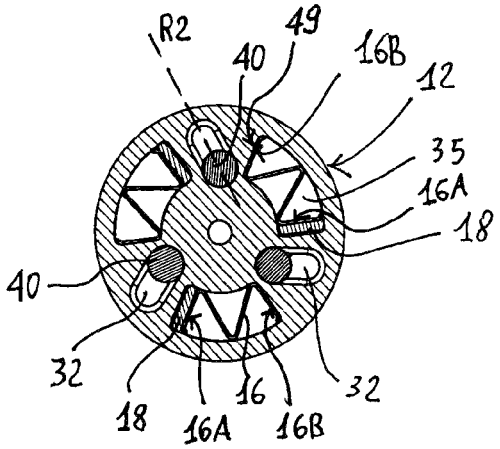

The sectional views of FIGS. 13 to 15 allow to understand certain aspects of the structure of the phase changer device 2 according to the present invention. In particular, the sections are defined with respect to sectional planes/lines which are orthogonal with respect to the rotation axis 101 of camshaft 10, as clearly indicated in FIG. 12. The sectional plane defining FIG. 13 crosses the first disc 11, while that defining FIG. 14 is axially positioned at the discoidal element 15. Finally, the sectional plane defining FIG. 15 crosses the second disc 12.

In the section in FIG. 13 the first disc 11 is seen in the foreground, and therefore the mutual position of the first grooves 31 is seen. A portion of the discoidal element 15 and of the second disc 12 are shown on the bottom of each first groove 31. In this regard, FIG. 13 indicates the three straight reference directions R1, R2, R3 defined above.

The sectional view in FIG. 14 allows to see in detail a preferred embodiment of the openings 41 crossing the discoidal element 15. In particular, each opening characterizes a first region 41A and a second region 41B which communicate with each other. The first region 41A is delimited by the half-slot shape defined by the guide surface 45 and in fact is the space—considered only in reference to the discoidal element 15—in which the corresponding ball 40 moves. The second region 41B has an annular sector-like shape and the corresponding elastic spring 16 is partially accommodated therein.

The sectional view in FIG. 15 allows to see the shape of the seats 35 of the second disc 12 in each of which a corresponding spring 16 is placed. The seats 35 also have an annular sector-like shape which is geometrically compliant with that of the second region 41B defined above for accommodating part of the corresponding spring 16. In this regard, the latter is conveniently shaped to compress upon a relative rotation of the discoidal element 15 with respect to the second disc 12.

Again with reference to FIG. 15, the second end 16B of the corresponding spring 16 resting against the first abutment surface 49 defined by a first side 35A of the seat itself, is shown in each of the seats 35. The same Figure also shows the second end 16B of the spring which rests against the second abutment surface 49 defined by the axial portion 18. Under a condition of unloaded spring, the axial portion 18 is placed in seat 35 so as to rest against the second side of the seat itself, opposite to that against which the first spring 16A rests.

FIGS. 16 to 25 allow to understand the of the phase changer 2 of the engine according to the present invention. In particular, FIGS. 16 to 20 (as well as the mentioned FIGS. 13 to 15) refer to device 2 in a first operating configuration for which the balls 40 occupy the first reference position closer to the rotation axis 101 of camshaft 10 (see in particular the sectional views 18 and 20). The position of the balls 40 is established by the rotation speed with which camshaft 10 is brought into rotation by the first disc 11. Therefore, the first reference position is kept as long as the rotation speed, i.e. the centrifugal force acting on the balls 40, is below a preset threshold. When this threshold is exceeded, the balls 40 start the movement thereof along the grooves 31, 32 of the two discs 11, 12, each remaining in contact with the related guide surface 45 of the discoidal element 15.

Angle $\alpha$ in FIG. 17 indicates the relative position of the first disc 11 with respect to flange 61 of sleeve 62. Angle $\alpha$ remains unvaried because the first disc 11 is integral with flange 61 in rotation about the first axis 101. Angle $\beta$ in FIG. 17 instead indicates the angular position of the first disc 11 with respect to the second disc 12 in said first operating configuration. Again in FIG. 17, another reference of such an angular position is point P1 indicated on the ring gear 111 defining the outer profile of the first disc 11.

Figure 20:
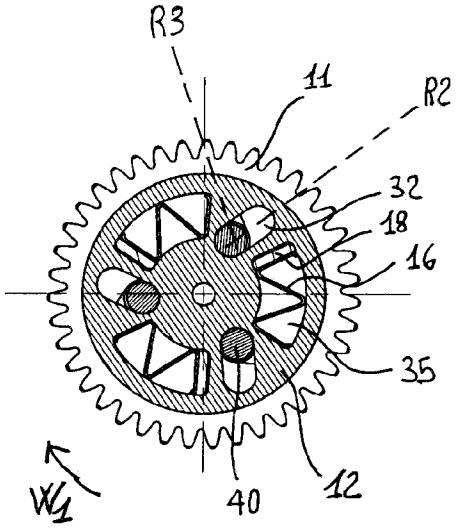
FIGS. 19 and 20 are a side view and a sectional view, respectively, of the camshaft in FIGS. 16 and 17, in which said sectional view in FIG. 20 is defined according to sectional line XX-XX in FIG. 19.
Figure 19:
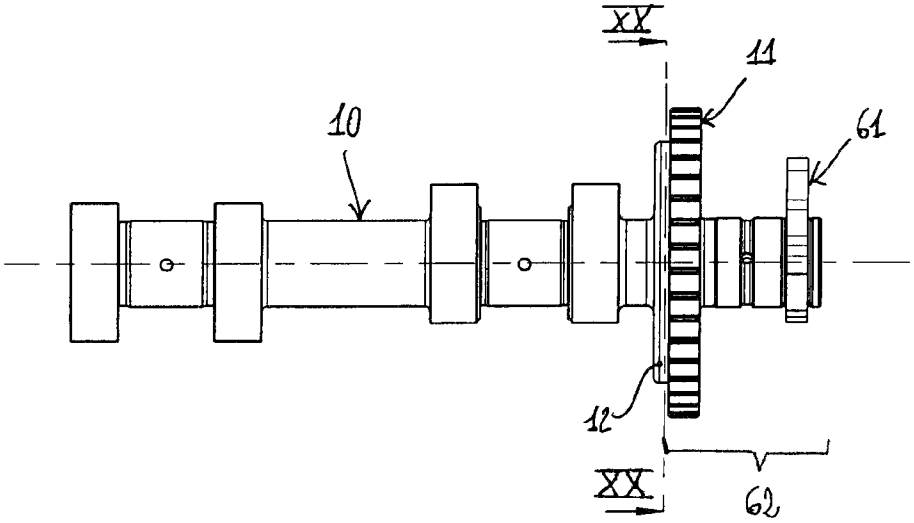

The sectional views of FIGS. 14 and 20 allow to see the condition of the retaining means 6 when the balls 40 occupy the first reference position. Each ball 40 is placed in contact with the guide surface 45 at an end part thereof closest to the rotation axis 101. Due to the shape thereof, the guide surface 45 tends to continuously oppose the movement of the balls 40 along the first grooves 31 and along the second grooves 32. As shown by FIGS. 13 and 20, the third direction R3 (feature of the guide surface 45) is tilted with respect to the reference directions R1 and R2 defining the grooves 31, 32 of the two discs 11, 12.

With reference to FIG. 20, it is assumed that the first disc 11 rotates clockwise (arrow $W_1$). The torque is transferred through the balls 40 to the second disc 12, and therefore to camshaft 10, which also rotate clockwise. Given that it is interposed between the two discs 11, 12, the discoidal element is also brought into rotation by the balls 40 about the rotation axis 101. As the rotation speed increases, the balls 40 start moving towards the second reference position, causing a relative rotation of the second disc 12 (and therefore of camshaft 10) with respect to the first disc 11. Such a relative rotation is seen in FIG. 22 by angle γ and by point P2 with respect to references β and P1, which are typical of the first operating configuration (FIG. 17).

It is worth noting that camshaft 10 in FIGS. 21, 22 and 23 is depicted in the same position shown in FIGS. 16, 17, and 18 so that the relative rotation between the discs 11, 12 is visible from the different angular position taken by the first disc 11. As already mentioned above, the rotation of the first disc 11 is in any case caused by an external element (distribution system or mechanical return system) and therefore, in reality it is the second disc 12 to rotate relatively to the first one to obtain the different timing of the valves.

Simultaneously to the relative rotation between the two discs 11, 12, a relative rotation of the discoidal element 15 is generated with respect to the two discs 11, 12 between which it is interposed as the rotation speed increases. In particular, the relative movement of the discoidal element 15 with respect to the second disc 12 causes a compression of the springs 16, which can be seen from the comparison between FIG. 20 and FIG. 25. The latter shows the condition of the retaining means 6 when the balls 40 occupy the second reference position. Again comparing FIGS. 20 and 25, the relative movement of the discoidal element 15 with respect to the second disc 12 may be seen from the different position taken by the axial portions 18 in the seats 35. Advantageously, the compression of the springs 16 keeps the guide surfaces 45 in contact with the balls 40 so as to oppose and therefore stabilize the movement of the balls 40 between the first reference position and the second reference position. At the same time, the springs 16 promote the return of the balls 40 towards the first reference position as the rotation speed decreases.

It is worth noting that the direction in which the relative rotation occurs between the two discs 11, 12 on the one hand and the relative rotation between the discoidal element 15 and the same two discs 11, 12 on the other depends on the above-indicated different inclination assigned to the reference directions R1, R2 and R3. In the case shown in the Figures, the two discs 11, 12 and the discoidal element 15 form a single system rotating about the same rotation axis 101. Assuming a clockwise rotation of the first disc 11 (indicated by arrow W1), the relative rotation of the second disc 12 with respect to the first disc 11 also occurs in clockwise direction, while the relative rotation of the discoidal element 15 with respect to the first disc 11 occurs in counterclockwise direction. The entity of the relative rotation between the discs 11, 12 depends on the angle (indicated by $\theta_1$) between the reference directions R1 and R2, while the entity of the relative rotation between the discoidal element 15 and the two discs 11, 12 depends on the angle (indicated by $\theta_2$) between direction R3 and direction R1.

The above-described technical solutions allow the tasks and preset objects to be fulfilled. In particular, using the retaining means opposing the movement of the drive elements advantageously allows a reduction of the number of the elements themselves and a significant simplification of the structure of the components of the phase changer device. In addition to this, due to the configuration of the phase changer device, the feature of the phase change advantageously is defined by the configuration assigned to the retaining means 6. With reference to the case shown in the Figures, such a feature is defined by the load of the elastic means and the shape of the guide surfaces of the discoidal element which radially contains the balls, defining the position thereof. In a different manner from the known solutions, if a different feature of the timing is required, it is sufficient to modify the structure of the retaining means without acting on the structure of the two discs, with apparent advantages in terms of costs. Finally, the configuration of the phase changer device allows a significant simplification of the preloading means which are not to have a complex elastic feature, contrarily to that instead required in the known solutions.

The invention claimed is:

1. An internal combustion engine for a motor vehicle having a ridable seat, wherein said engine comprises a drive shaft and a camshaft which controls a plurality of opening or relief valves, wherein said engine comprises a device for changing the timing of said valves with respect to said drive shaft, wherein said device comprises:

a first disc idly mounted to said camshaft so as to rotate about the same rotation axis as said camshaft, wherein said first disc comprises a first side defining first tracks, each of which extends along a first reference direction;

a second disc which is integral with said camshaft, wherein said second disc comprises second tracks facing said first side of said first disc, wherein each of said second tracks partially faces a corresponding first groove of said first disc and wherein each of said second tracks extends along a second reference direction which is different from said first direction;

a plurality of drive elements for transmitting the motion between said first disc and said second disc, wherein said drive elements are interposed between said discs and wherein each drive element is accommodated between corresponding two of said partially facing tracks, and wherein as the centrifugal force caused by the rotation speed of said camshaft changes, each of said drive elements moves along said corresponding partially facing tracks between a first reference position and a second reference position which are close to and far from the rotation axis of said camshaft, respectively;

axial preloading means which act on said first disc, thus preventing a translation of said first disc with respect to said second disc along a direction parallel to the rotation axis of said camshaft, wherein said device comprises means for retaining said drive elements, wherein said retaining means are operatively interposed between said first disc and said second disc and exert a force which tends to oppose the movement of said drive elements towards said second reference position, wherein said retaining means comprise:

a discoidal element interposed between said first disc and said second disc so as to freely rotate with respect to each of said discs; wherein said discoidal element defines at least one opening crossed by said drive elements, wherein said at least one opening defines a plurality of guide surfaces, each of which comes into contact with a corresponding one of said drive elements during the movement between said reference positions;

elastic means interposed between one of said discs and said discoidal element so as to exert a force on said discoidal element which keeps each of said guide surfaces in contact with said corresponding one of said drive elements.

2. The engine according to claim 1, wherein said engine comprises a distribution system for rotating said first disc, said distribution system comprising a first distribution wheel keyed onto said drive shaft, a second distribution wheel which is integral with said first disc, and a flexible drive element which connects the two distribution wheels so that the rotation of saki drive shaft is transferred to said first disc.

3. The engine according to claim 2, wherein said engine comprises a sleeve body which is made in one piece with said first disc, wherein said first disc is defined at a first end of said sleeve body, which comprises a flange portion defined at a second end, said second distribution wheel being connected to said flange portion of said sleeve body.

4. The engine according to claim 3, wherein said ,reloading means comprise a cup spring which acts on said flange portion so as to push said sleeve body towards said second disc, wherein said cup spring is interposed between said flange portion and an adjusting screw which is coaxially screwed to an end of said camshaft so that the rotation of said screw causes a compression of said cup spring.

5. The engine according to claims 1, wherein said first disc comprises a ring gear for transmitting the rotation motion to a further camshaft or for receiving the rotation motion from a further camshaft, wherein said further camshaft is different from that to which said first disc is mounted.

6. The engine according to claims 1, wherein said discoidal element comprises an opening for each of said drive elements, wherein each opening defines a guide surface which at least partially extends according to a third straight reference direction which is tilted with respect to said first direction and said second direction.

7. The engine according to claims 1, wherein said elastic means comprise an elastic spring for each opening, wherein each elastic spring rests, with a first end thereof, on a first abutment surface defined by said discoidal element, and with a second end thereof, which is opposite to said first end, on a second abutment surface defined by said second disc.

8. The engine according to claim 7, wherein, for each spring, said corresponding first abutment surface is defined by a portion which axially emerges from a first side of said discoidal element facing said second disc, wherein, for each spring, said second abutment surface is defined instead by a first side of a seat defined on a side of said second disc facing said discoidal element, and wherein, for each spring, said axial portion is placed in said seat in a position close to a second side.

9. The engine according to of claims 1, wherein said drive elements are balls made of metal material.

10. The engine according to claims 1, wherein said first tracks of said first disc have a tapered shape in an opposite direction to said second disc , and said second tracks of said second disc have a tapered shape in an opposite direction to said first disc.

* * * * *